US006530467B2

(12) United States Patent
Arai et al.

(10) Patent No.: US 6,530,467 B2
(45) Date of Patent: Mar. 11, 2003

(54) MATERIAL TRANSPORT DEVICE

(75) Inventors: Toshihiko Arai, Kanagawa-ken (JP); Nobuyoshi Maeda, Kanagawa-ken (JP)

(73) Assignee: Aida Engineering Co., Ltd., Kanagawa (JP)

( * ) Notice: Subject to any disclaimer, the term of this patent is extended or adjusted under 35 U.S.C. 154(b) by 0 days.

(21) Appl. No.: 10/055,141

(22) Filed: Jan. 22, 2002

(65) Prior Publication Data

US 2002/0141857 A1 Oct. 3, 2002

(30) Foreign Application Priority Data

Mar. 19, 2001 (JP) ..... 2001-077846

(51) Int. Cl.[7] ..... B65B 75/58; B65B 37/00

(52) U.S. Cl. ..... 198/468.5; 271/264; 271/276; 271/193

(58) Field of Search ..... 271/275, 251, 271/274, 3.21, 3.23, 273, 253, 213, 193, 18.1, 18.2, 276, 196, 197, 84; 198/468.4, 468.5

(56) References Cited

U.S. PATENT DOCUMENTS 1,329,962 A * 2/1920 Ennis ..... 198/721
2,722,406 A * 11/1955 Kurek ..... 366/209
4,372,538 A * 2/1983 Balfanz ..... 266/69

* cited by examiner

*Primary Examiner*—Donald P. Walsh
*Assistant Examiner*—Kaitlin S. Joerger
(74) *Attorney, Agent, or Firm*—Darby & Darby

(57) ABSTRACT

A plurality of shuttle bars are guided in a feed direction below a guide body. The shuttle bars are spaced to fit between a plurality of conveyor belts which transport a sheet of material suspended below them toward a press. The guide body is lowered to move the shuttle bars far enough between the conveyor belts to disengage the sheet of material from the conveyor belts. The shuttle bars each includes a device for attachment to the sheet of material, whereby the sheet of material is conveyed the remainder of the way to the press attached to the shuttle bars.

4 Claims, 5 Drawing Sheets

MATERIAL TRANSPORT DEVICE

BACKGROUND TO THE PRESENT INVENTION

The present invention relates to a material transport device that supplies blank material to a transfer press machine. Described in more detail, the present invention relates to a material transport device that supplies blank material that sags easily because of its large size.

Material supply devices for supplying blank material from a destack device to a transfer press are disclosed in the prior art. Japanese Patent Publication Number 3010401 discloses an intermediate transport device, wherein: a blank material loaded on a destack device is passed from an attaching piece to a lower surface of a first magnet conveyor. Next, the material is passed to an upper surface of a second magnet conveyor and is transported to a final stage. At the final stage, because of the rising of a chute, the blank material is separated from the second magnet conveyor. Finally, a feed bar of the transfer press clasps the blank material from the chute and transports it to the first stage of the press.

In recent years, people in the press working industry have been studying how to use a single transfer press to process large blank materials or sheet materials (for example, having a front-back dimension of 1300 mm or greater) that have previously been processed by a press line (a so-called tandem line) in which loaders and unloaders are stationed between a plurality of presses. This has become realizable due to the improvement in die technology. By conducting production with a single transfer press, advantages over the tandem line, such as space conservation, improved production speed, and the like, are anticipated.

With a material transport device of the prior art as disclosed in the previously described Patent Publication Number 3010401, the large blank material or sheet material that is loaded on a destack device can be transported to the final stage. The blank material is transported from the final stage to the first stage of the press, where processing is begun, by clasping the edges of the blank material with feed bar fingers. Such edge support of a blank material that is large and has a weak middle, permits the center part of the blank material to sag, thus making transport difficult. In order to solve this problem, clip fingers and the like have been tried, but an adequate transport capability has not been achieved.

OBJECT AND SUMMARY OF THE INVENTION

The object of the present invention is to provide a material transport device that reliably transports large blank materials and sheet materials to the first stage of a press without permitting the material to sag.

The invention described is a material transport device, comprising: a guide body that can be raised and lowered; a plurality of shuttle bars that move in a feed direction by being guided by the guide body and that are provided between a plurality of magnet belts which transport the blank material to a final stage; and an attachment member that is provided on a lower surface of the shuttle bar and attaches and retains the blank material. By lowering the shuttle bar and the attachment member together with the guide body, the blank material that is attached to a lower surface of the magnet belt is separated from the magnet belt. The attachment member attaches and retains the blank material. By moving the attachment member together with the shuttle bar to a first stage, the blank material is transported to the press machine.

According to the invention, the blank material, which has been transported to the final stage attached to the lower surface of the magnet belt, is separated from the magnet belt by the attachment member that descends from above the blank material. In addition, the blank material is attached and retained by the attachment member. Because the attachment member and the shuttle bar move together, the blank material is. transported to the first stage while the blank material is being attached and retained by the attachment member. The blank material is then released at the first stage.

For the transport from the final stage to the first stage, the blank material is attached and retained by a plurality of attachment members. In other words, with blank materials that are large and have a weak middle, because they are retained at a plurality of points, the sagging of the center portion that occurs when the edges are clasped by fingers is avoided, and the blank material is reliably transported to the first stage.

The blank material is processed at the first stage so that it has a higher form rigidity. As a result, the blank material can be transported to the next step by clasping the edges with feed bar fingers. In other words, transport from the first stage and beyond is reliably conducted with feed bars.

With the present invention, even a large blank material with a weak middle is reliably transported from the final stage to the first stage. As a result, the processing of a large blank material (sheet material) that had been processed by a tandem line in the prior art is processed by a transfer press.

Furthermore, when the present invention is used in a system in which the central feed bar is removed together with the moving bolster during die exchanges, the left-right dimension of the press is reduced by an equivalent of one stage compared to the standard press. In other words, usually, the length of the feed bar must be enough to reach the final stage. However, with the present invention, the material is transported to the first stage, and the central feed bar needs only to be long enough to reach this first stage. If the center feed bar is shortened by the length of one stage, the dimension between the left and right columns is also shortened. This results in large cost savings, and the rigidity of the press is improved.

Furthermore, because the final stage does not require a chute as in the transport device of the prior art, a space is formed below the final stage. An oil coating device, for example, may be placed in this space. This is advantageous when oil is coated on both sides of a blank material as when molding a high tension steel plate.

In addition, the invention is a material transport device as described above, wherein the attachment member is formed by a magnet.

Furthermore, the invention is a material transport device as described above wherein the attachment member is formed by a vacuum cup.

According to the invention, in addition to the advantages of the invention described above, by forming the attachment member from a magnet, the attachment member is inexpensive. In addition, according to the invention, in addition to the advantages of the invention described above, by forming the attachment member from a vacuum cup, transport is reliably conducted even when transporting large blank materials that are not magnetic.

DETAILED DESCRIPTION OF THE PREFERRED EMBODIMENTS

Figure 1:
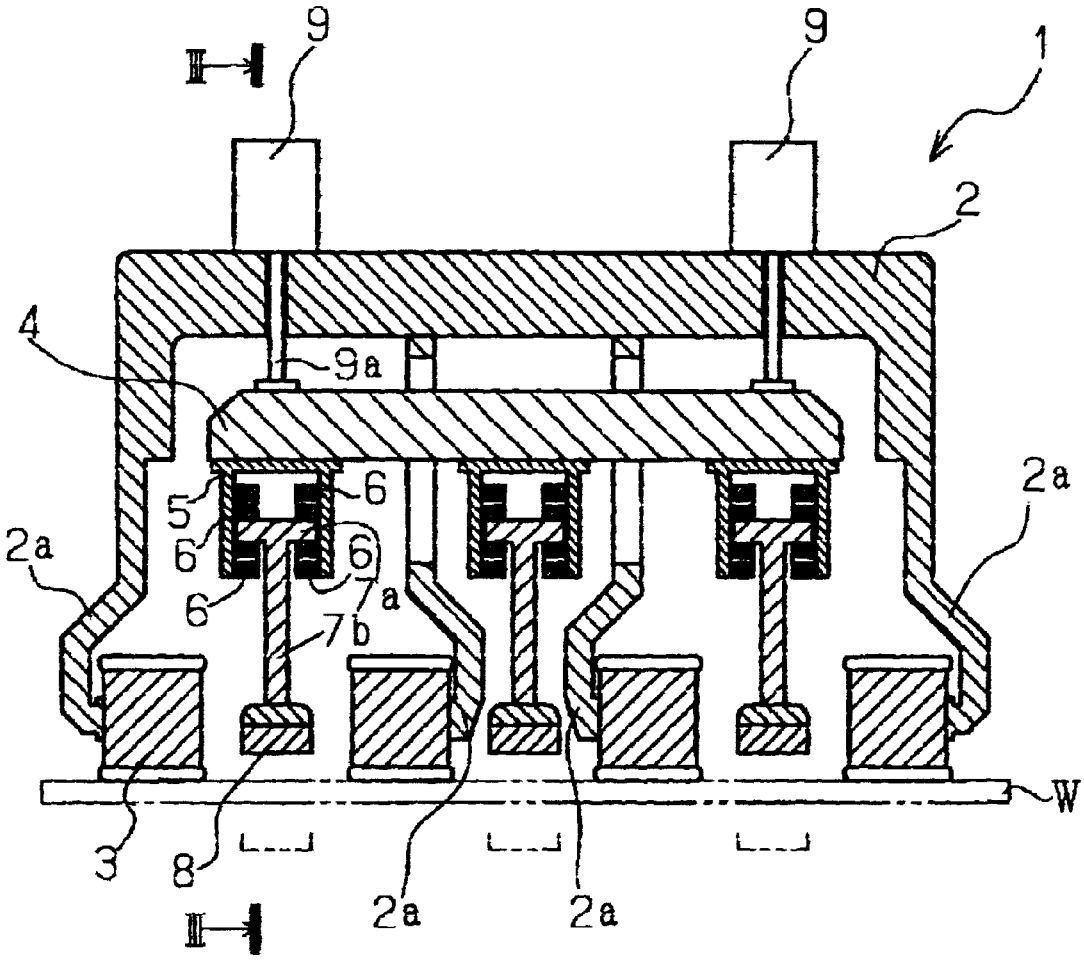
FIG. 1 is a cross-section along line I—I of FIG. 3 of a material transport device according to an embodiment of the present invention.
Figure 3:
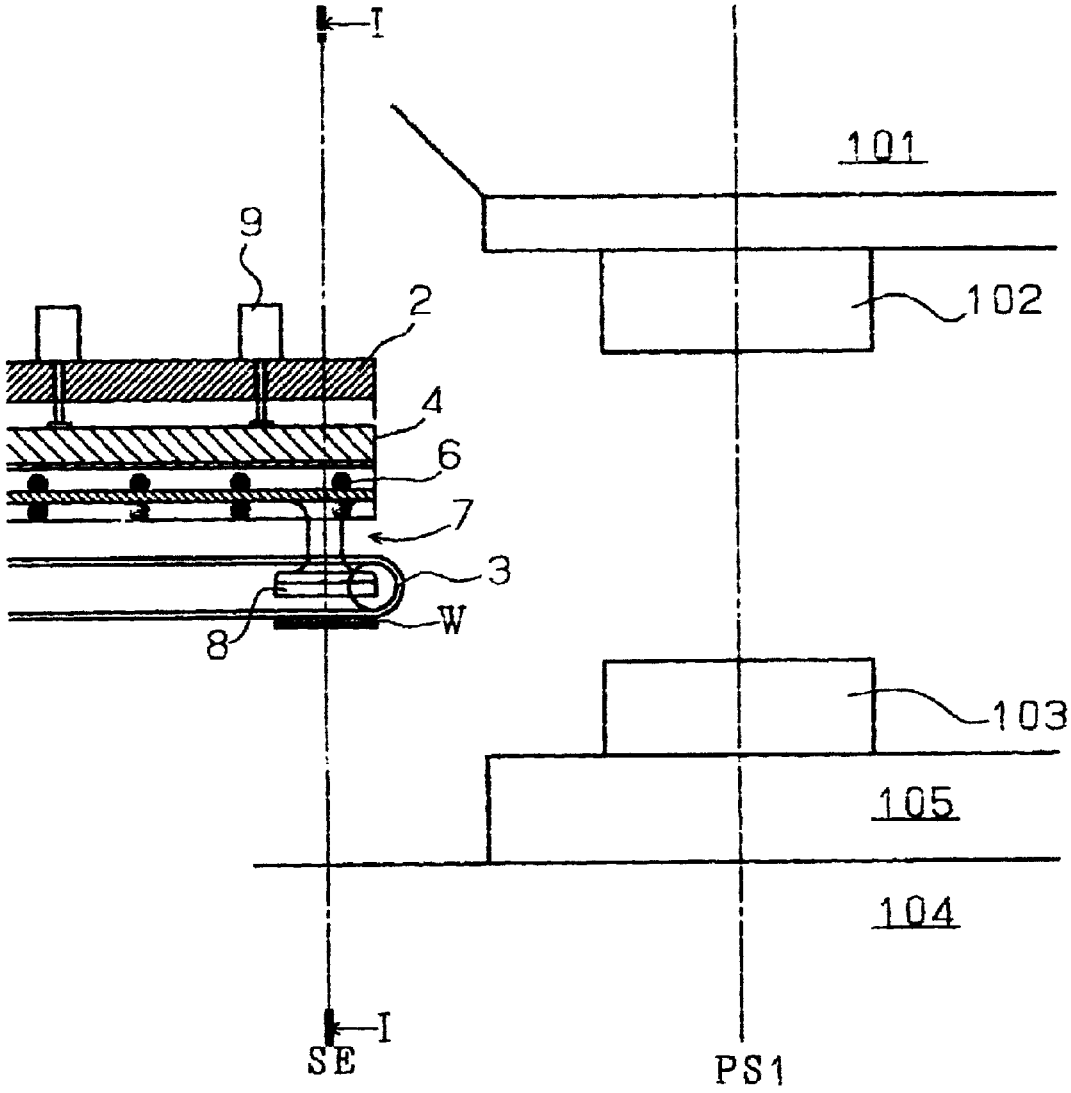
FIG. 3 is a cross-section along line II—II of FIG. 1 of the material transport device according to an embodiment of the present invention.

Referring to FIG. 1, a material transport device 1 includes a frame 2 affixed to a side surface or the like of a press (not shown). Referring now also to FIG. 3, a slide 101 of the transfer press includes an upper mold 102 affixed to its lower surface. A lower mold 103 is affixed to a bolster 105 on the upper surface of a bed 104 facing upper mold 102. A first stage PS1, which is the beginning of the processing by the transfer press, is formed by upper mold 102 and lower mold 103.

A magnet conveyor 3 is supported by a support piece 2*a* of frame 2. A blank material loaded onto a destack device (not shown) or a blank material that is blanked by a blanking press is transported by magnet conveyor 3 to a final stage SE. Magnet conveyor 3 is arranged in four rows.

A guide body 4, shaped as a flat sheet, is disposed in the interior of frame 2. A plurality of guide pieces 5 are affixed to the lower surface of guide body 4. Each guide piece 5 is a steel channel, for example, with a C-shaped cross-section. The open side of the C-shaped cross section of each guide piece 5 faces downward. The left and right inner surfaces of guide pieces 5 contain a plurality of cam followers 6 that maintain constant vertical and longitudinal intervals.

A shuttle bar 7 supports a board member 7*a* which is connected to a downward-facing attachment member support piece 7*b*. An attachment member 8 (in the present embodiment, a magnet for example) is affixed to the lower surface of attachment member support piece 7*b*. Attachment member 8 performs attachment, retention, and release under control of a control device not shown. Both ends of board member 7*a*, as seen in cross-section, slidably fit into the vertical interval of cam follower 6. In this way, a shuttle bar 7 is guided along its path by guide body 4. This permits shuttle bar 7 to move in the directions between final stage SE and first stage PS1. In this way shuttle bar 7 is free to move in the feed direction.

Figure 2:
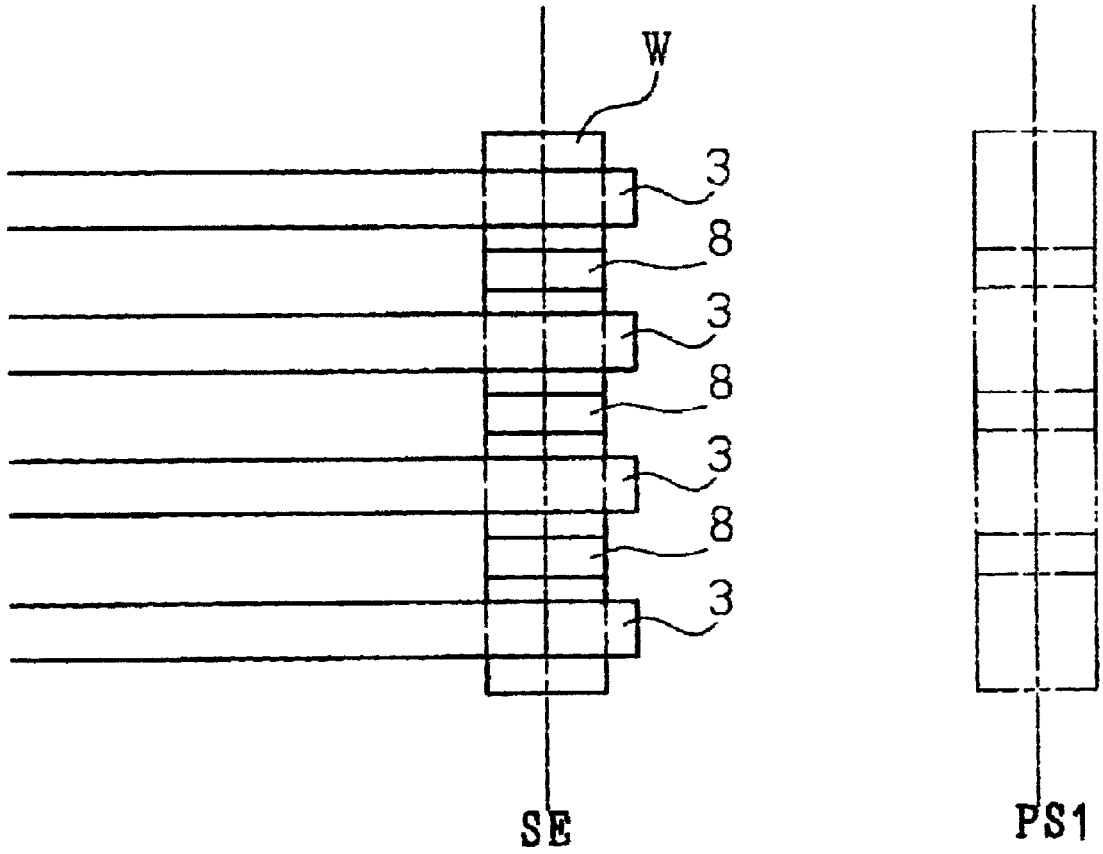
FIG. 2 is a schematic layout drawing of members as seen from above in FIG. 3.

Referring now also to FIG. 2, guide piece 5, shuttle bar 7, attachment member 8, and their related parts, are arranged in three rows aligned in the spaces between the four rows of magnet conveyors 3. Depending on the mode of implementation, the number of rows is increased or decreased. Attachment member 8 is controlled by a control device attach, retain, and release a blank material. Other modes (for example, a vacuum cup) can be substituted for magnets without departing from the scope of the invention. Furthermore, the guide of shuttle bar 7 can be anything that can provide guidance for board member 7*a*. For example, a liner can be used.

A plurality of hydraulic cylinders 9 are affixed to the upper surface of frame 2. A rods 9*a* extends downward from each hydraulic cylinders 9, passing through the upper surface board piece of frame 2 and joining the upper surface of guide body 4. Hydraulic cylinders 9 are thus capable of raising and lowering guide body 4 in the vertical direction. Shuttle bar 7 and attachment member 8 and their related elements move upward and downward with guide body 4. Hydraulic cylinder 9 may be replaced by other means for urging guide body upward and downward. For example, a motor, air cylinder, and the like can also be used.

FIGS. 1–3 show guide body 4 raised to its upper limit. Two-dash lines in FIGS. 1 and 3 show the positions of attachment members 8 at their lower limit.

Referring to FIG. 3, in operation, guide body 4, shuttle bar 7 and attachment member 8, are moved with guide body 4 to their upper limit. A blank material W, is transported from a destack device or blanking press (not shown) to final stage SE by magnet conveyor 3. Rods 9*a* of hydraulic cylinders 9 are activated to lower guide body 4 together with shuttle bar 7 and attachment member 8.

Figure 4:
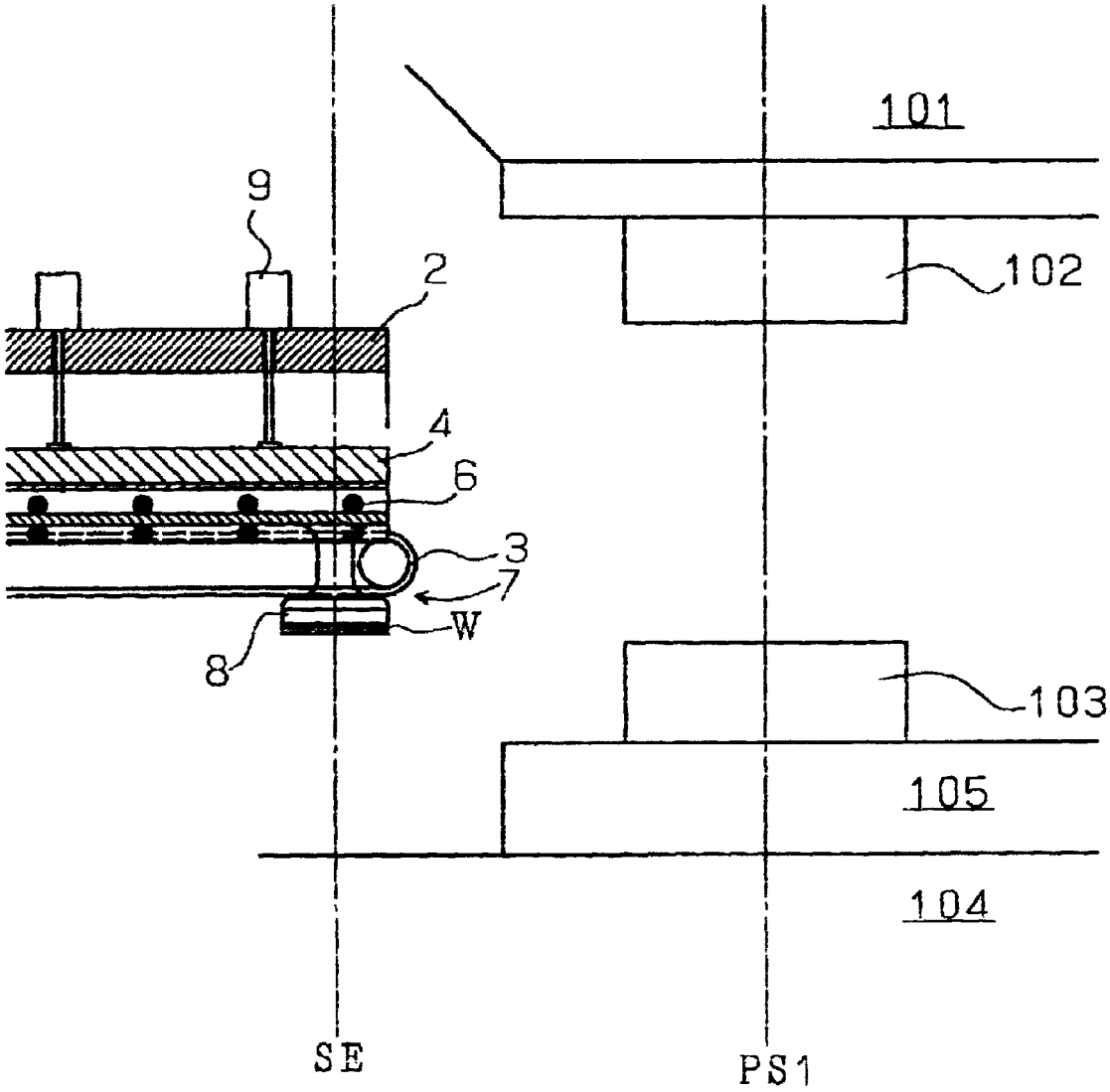
FIG. 4 is a figure of the same format as FIG. 3 shown when the blank material is separated.

When guide body 4 is lowered, the lower surface of attachment member 8 contacts the upper surface of blank material W. Blank material W is attracted to, and is thus attached to the lower surface of attachment member 8. Guide body 4 continues its descent, whereby blank material W is separated from magnet conveyor 3 (FIG. 4). Blank material W is attached and retained by attachment members 8.

Figure 5:
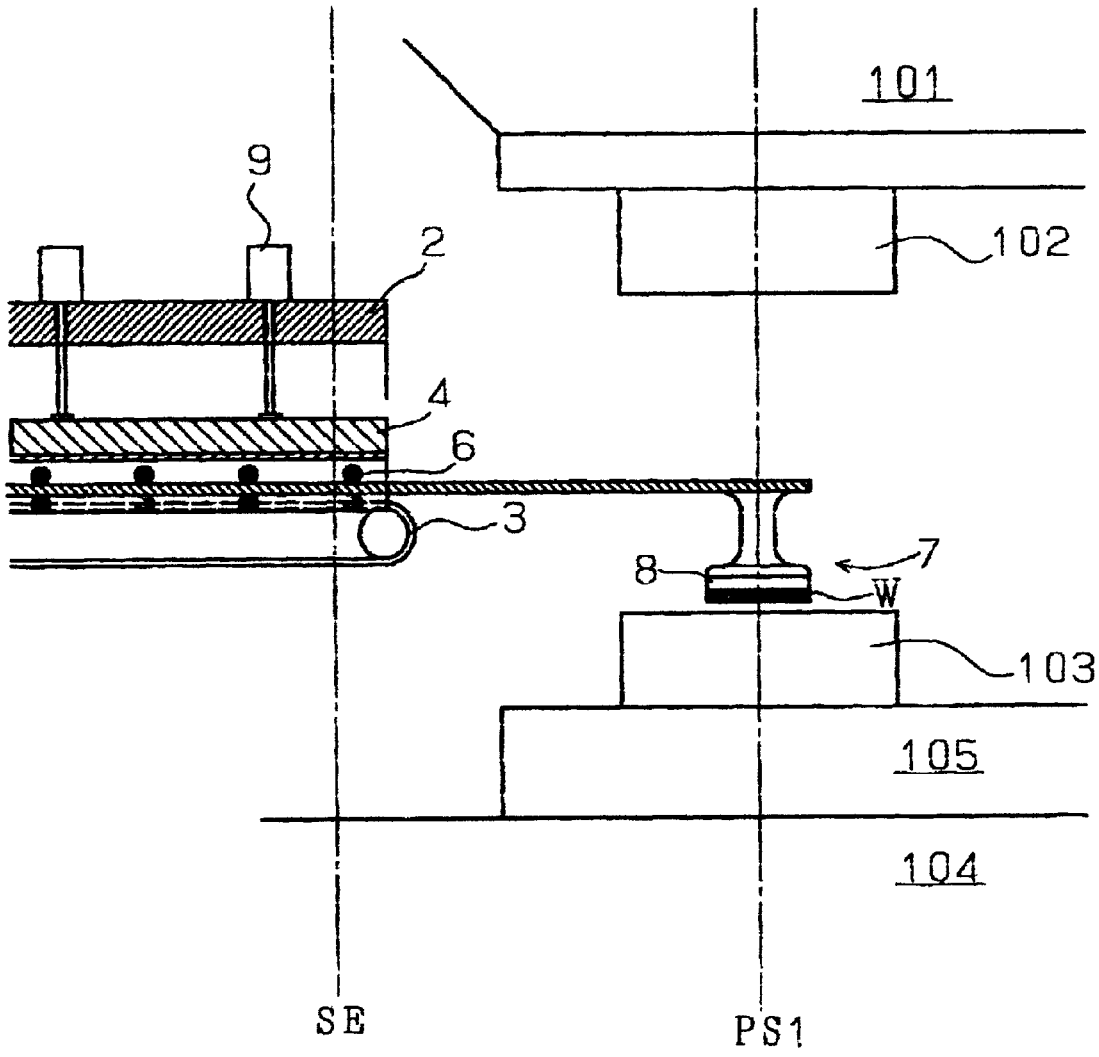
FIG. 5 is a figure of the same format as FIG. 3 shown when the shuttle bar has reached the first stage.

Shuttle bar 7 is shifted towards first stage PS1 by a driving device (not shown). When blank material W reaches first stage PS1 (lower mold 103), attachment member 8 releases blank material W (FIG. 2, FIG. 5). After releasing blank material W, shuttle bar 7 retreats in the direction of final stage SE. Guide body 4 is raised to its upper limit in preparation for receiving a new blank material when it at final stage SE. In this manner, by repeating the above motions, blank materials W are sequentially transported and are transported to the transfer press.

As shuttle bar 7 begins its retreating motion, slide 101 is lowered. Blank material W is pressed between upper mold 102 and lower mold 103 to complete the pressing operation. Finally, blank material W is transported to the next operation by a feed bar (not shown).

Even if blank material W is large and has a weak middle, because several attachment members 8 (in the present embodiment, there are three rows) are used to attach and retain blank material W, sagging of the material is prevented as blank material W is transported from final stage SE to first stage PS1. Thus, blank material W is reliably transported to the press (first stage PS1).

For the transport to the steps following first stage PS1, the rigidity of blank material W is increased due to the press operation at first stage PS1. In many cases, the rigidity is sufficient to permit transport by feed bar fingers.

When the transfer press using the present device is a system that removes the central feed bar together with the moving bolster, the length of the central feed bar needs only to be long enough for feeding blank material W to the first stage. As a result, the left to right dimension of the press is shortened as compared to the prior art.

Furthermore, transport device 1 of the present invention can also be used for handling blank material W which is a high tension steel plate. Such materials frequently require that one or both surfaces of blank material W be coated with oil. Because the chute and the like of the prior art are omitted beneath final stage SE, the space thus freed up underneath final stage SE may be used for the placement of an oil coating device. As an example of an oil coating device, nozzles may be attached to the ends of several tubes. The nozzles receive oil from a pump. Oil is intermittently sprayed upward from the nozzles onto the underside of blank material W, to which it adheres. For oil coating the upper surface of blank material W, various oil coating devices, such as a drip method, in which oil is dripped via a tube, may be used.

With the present invention, when processing a large blank material W (sheet material) with a weak middle by a transfer press, the blank material is reliably transported from the final stage to the first stage. Furthermore, in a system wherein a central feed bar is removed together with a moving bolster, the left-right dimension of the press is shortened, and the press rigidity is increased, and costs are lowered. Furthermore, because space not available in the prior art is freed up underneath the final stage, this space can be used for an oil coating device and the like.

What is claimed is:

1. A material transport device, comprising:

a guide body;

means for raising and lowering said guide body;

a plurality of guide pieces affixed to a lower surface of said guide body;

said guide pieces being substantially parallel, and being directed in a feed direction of said transport device;

a first plurality of spaced-apart conveyor belts;

said conveyor belts being controllable for movement in said feed direction;

said conveyor belts including means for attracting and retaining said material;

a second plurality of shuttle bars guided in said guide pieces;

said second plurality being spaced to fit between said first plurality;

each of said shuttle bars including at its extremity means for attaching to said material;

said means for attaching being effective for disengaging said material from said conveyor belts as said guide body is lowered; and means for permitting said shuttle bars, with said material affixed thereto, to move in said feed direction to move said material to a press machine.

2. A material transport device as described in claim 1, wherein at least one of said means for attracting and retaining and said means for attaching includes magnetic means.

3. A material transport device as described in claim 1, wherein at least one of said means for attracting and retaining and said means for attaching includes a vacuum device.

4. A material transport device comprising:

a guide body;

a plurality of shuttle bars;

means for guiding said shuttle bars a feed direction below said guide body;

a plurality of conveyor belts movable in said feed direction;

said conveyor belts being spaced apart;

said shuttle bars being spaced to fit between adjacent ones of said conveyor belts;

said conveyor belts including first means for suspending said material therebelow;

each of said shuttle bars including second means for suspending said material therebelow;

means for moving said guide body downward sufficiently to disengage said material from said first means for suspending, whereby said material becomes attached to said second means for suspending; and said means for guiding permitting delivery of said material, attached to said second means for suspending, to a press.

* * * * *